US005350327A

United States Patent [19]

Self et al.

[11] Patent Number: 5,350,327

[45] Date of Patent: Sep. 27, 1994

[54] DEVICE TO PERMIT AN OUTBOARD MOTOR BOAT TO OPERATE IN SHALLOW WATER

[76] Inventors: Robert W. Self, 213 Frazer St., Lake Charles, La. 70605; Karl Styron, P.O. Box 153, Creole, La. 70632

[21] Appl. No.: 107,897

[22] Filed: Aug. 18, 1993

[51] Int. Cl.[5] ..... B63H 21/26

[52] U.S. Cl. ..... 440/66; 114/274; 114/280

[58] Field of Search ..... 440/53, 61, 66, 67, 440/68, 69; 114/274, 280, 284, 285; 248/642

[56] References Cited

U.S. PATENT DOCUMENTS

| | | | |
|---|---|---|---|
| 2,355,842 | 8/1944 | Arado . | |
| 2,690,728 | 10/1954 | Cavanaugh . | |
| 2,747,819 | 5/1956 | Aldrich et al. . | |
| 2,757,888 | 8/1956 | Branstrator . | |
| 3,032,304 | 1/1960 | Machlan . | |
| 3,245,641 | 4/1966 | Hart . | |
| 3,768,432 | 10/1973 | Spaulding . | |
| 4,013,249 | 3/1977 | Meyer et al. . | |
| 4,657,513 | 4/1987 | Baker | 440/66 |
| 4,741,714 | 5/1988 | Uchida et al. | 440/66 |
| 4,744,779 | 5/1988 | Koealer | 440/66 |
| 4,836,124 | 6/1989 | Haasl | 440/61 |
| 4,890,811 | 1/1990 | Ehni | 440/61 |
| 4,915,668 | 4/1990 | Hardy . | |
| 4,995,839 | 2/1991 | Havins | 440/53 |
| 5,061,214 | 10/1991 | Monaghan . | |

*Primary Examiner*—Stephen P. Avila

*Attorney, Agent, or Firm*—Shlesinger Arkwright & Garvey

[57] ABSTRACT

A device for permitting an outboard motor boat to operate in shallow water, comprises a first support for securing to a transom of a boat and extending rearwardly therefrom; a keel secured to the first support and extending downwardly therefrom and rearwardly from the transom; a vertically adjustable motor mount for supporting an outboard motor with a propeller housing having a leading surface, the motor mount for positioning the motor in a raised position to permit the boat to operate in shallow water and a lowered position in normal-depth water; and the keel includes a rear edge substantially parallel and adjacent to the leading surface of the propeller housing when the motor mount is in the raised position.

41 Claims, 9 Drawing Sheets

FIG. 5
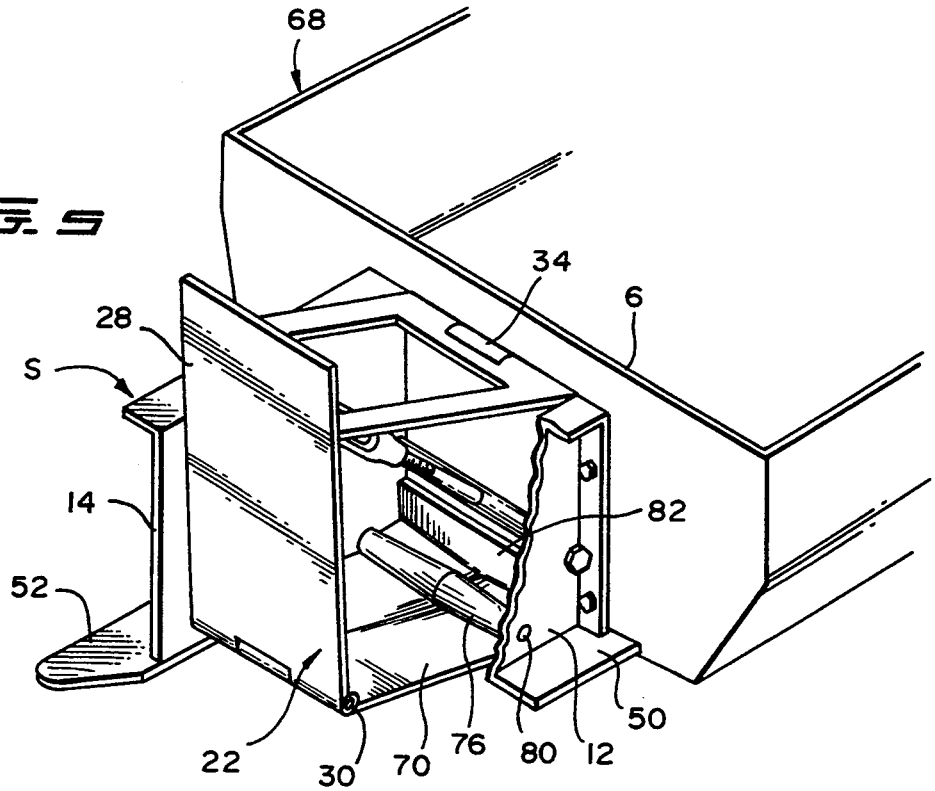
FIG. 6
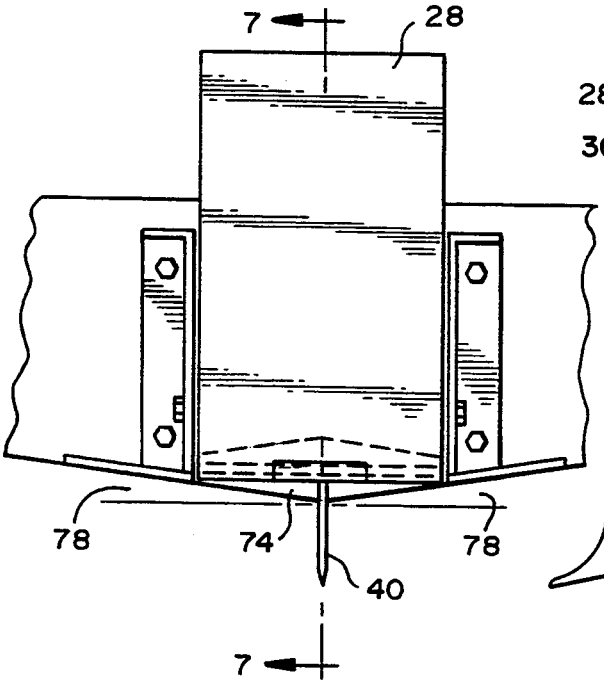
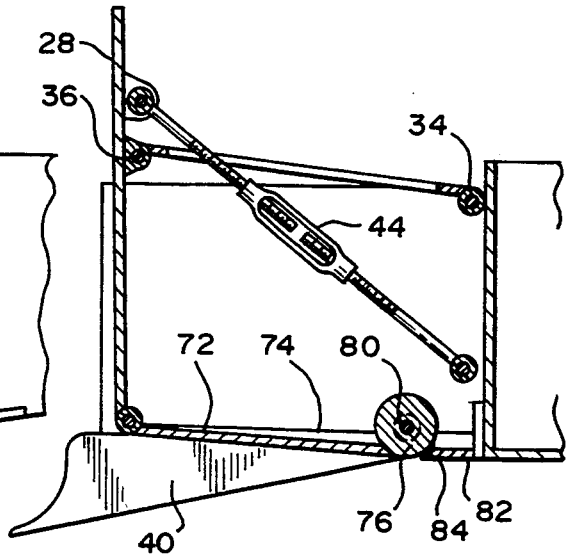
FIG. 7

DEVICE TO PERMIT AN OUTBOARD MOTOR BOAT TO OPERATE IN SHALLOW WATER

FIELD OF THE INVENTION

The present invention relates generally to outboard motor boats and specifically to a device for adapting an outboard motor boat to operate in shallow water.

BACKGROUND OF THE INVENTION

Along the Gulf Coast are many shallow marsh areas with varying amounts of underwater vegetation. These areas are used for water fowl hunting, fishing and trapping. While trapping is performed by a relatively few, fishing and hunting are enjoyed by a majority of the people in these areas. Most of the Federal Wildlife Reserves and privately owned marshes open for fishing limit the horsepower of boats to typically 25 h.p. Most of the boats used in fishing are factory manufactured outboard motor boats.

An increasing number of homemade aluminum tunnel boats are appearing on the scene in an effort to run in shallower water. These tunnel boats have a section of the bottom tunneled at the rear of the boat that allows the water to rise up in the rear. The motor can then be raised several inches. Forward motion of the boat causes the tunnel to fill with water which then flows out of the rear end, providing water for the propeller. The limit to raising the motor is dictated by the requirement that the water suction of the motor be submerged when the boat is at rest. This gives the tunnel boat an advantage in shallow water.

Notwithstanding the advantages, a tunnel boat is not efficient when pulling a load, such as a shrimp trawl, another boat, etc., where a normal (non-tunneled) boat would be better suited for the job. Additionally, a tunnel boat is relatively inefficient and has a tendency for the bow to rise inordinately high above the water, contributing to instability and increased "porpoising" motion.

There is therefore a need for an outboard motor boat that operates normally in normal-depth water and that can be configured relatively easily to operate in shallow water that is relatively more efficient and stable than a tunnel boat.

OBJECTS AND SUMMARY OF THE INVENTION

It is therefore an object of the present invention to provide a device for an outboard motor boat that permits it to operate in shallow water but without the considerable power requirement of a tunnel boat.

It is another object of the present invention to provide a device for an outboard motor boat that permits the boat to operate in shallow water in areas of heavy underwater vegetation without fouling the propeller.

It is still another object of the present invention to provide a device for an outboard motor boat that permits it to operate both in normal-depth water and shallow water.

It is yet another object of the present invention to provide a device for an outboard motor boat that permits it to operate in shallow water at a relatively higher efficiency than a tunnel boat.

It is another object of the present invention to provide a device for an outboard motor boat that permits it to operate in shallow water while maintaining the boat relatively level and stable.

It is yet another object of the present invention to provide a device for retrofitting an outboard motor boat to permit it to operate in shallow water.

It is yet another object of the present invention to provide a device that is relatively inexpensive to manufacture for an outboard motor boat to permit it to operate in shallow water.

In summary, the present invention provides a device for an outboard motor boat that permits the boat to operate both in normal-depth and shallow waters at a relatively higher efficiency and stability than a tunnel boat.

These and other objects of the present invention will become apparent from the following detailed description.

BRIEF DESCRIPTIONS OF THE DRAWINGS

FIG. 5 is a perspective broken away view of another embodiment of the present invention for a semi-V bottom boat.

FIG. 6 is an end elevational view of FIG. 5.

FIG. 7 is a side cross-sectional view taken along line 7—7 of FIG. 6.

DETAILED DESCRIPTION OF THE INVENTION

Figure 1:
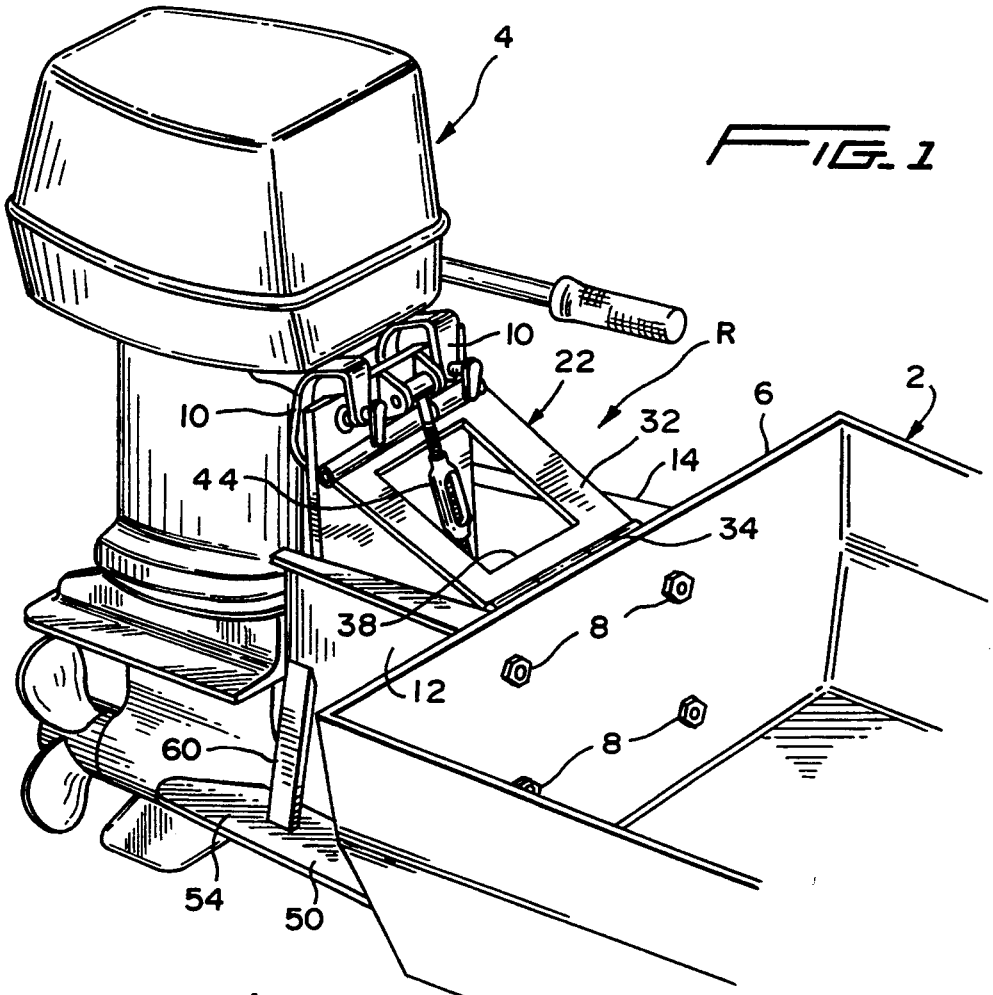
FIG. 1 is a perspective view of a device of the present invention shown secured to the transom of an outboard motor boat and supporting an outboard motor to permit the boat to operate in shallow water.

A device R in accordance with the present invention for permitting a boat 2 with an outboard motor 4 to operate in shallow water is disclosed in FIG. 1. The device R is secured to the transom 6 of the boat 2 by conventional means, such as bolts 8. The motor 4 is removably secured to the device R by means of clamps 10 or other suitable means.

Figure 2:
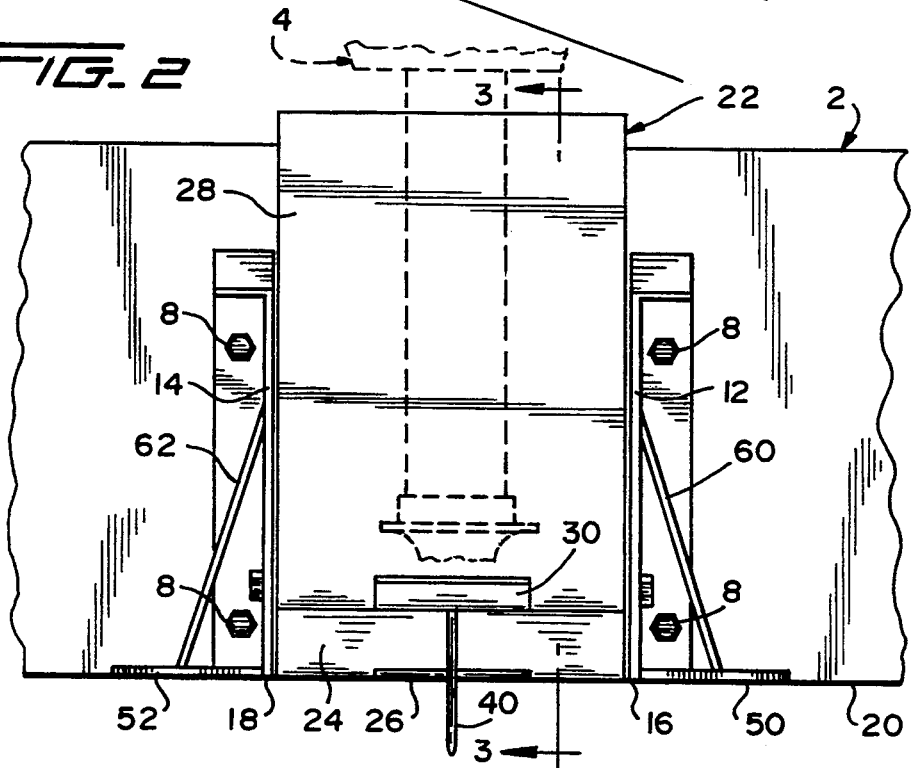
FIG. 2 is a rear elevational view of the device of FIG. 1, with the outboard motor shown in phantom lines.

The device R has two side plates 12 and 14 disposed substantially parallel to each other and secured to the transom 6 by the bolts 8, as best shown in FIGS. 1 and 2. The side plates 12 and 14 have bottom edges 16 and 18 that are substantially aligned with the bottom surface 20 of the boat 2, as best shown in FIG. 2.

Figure 3:
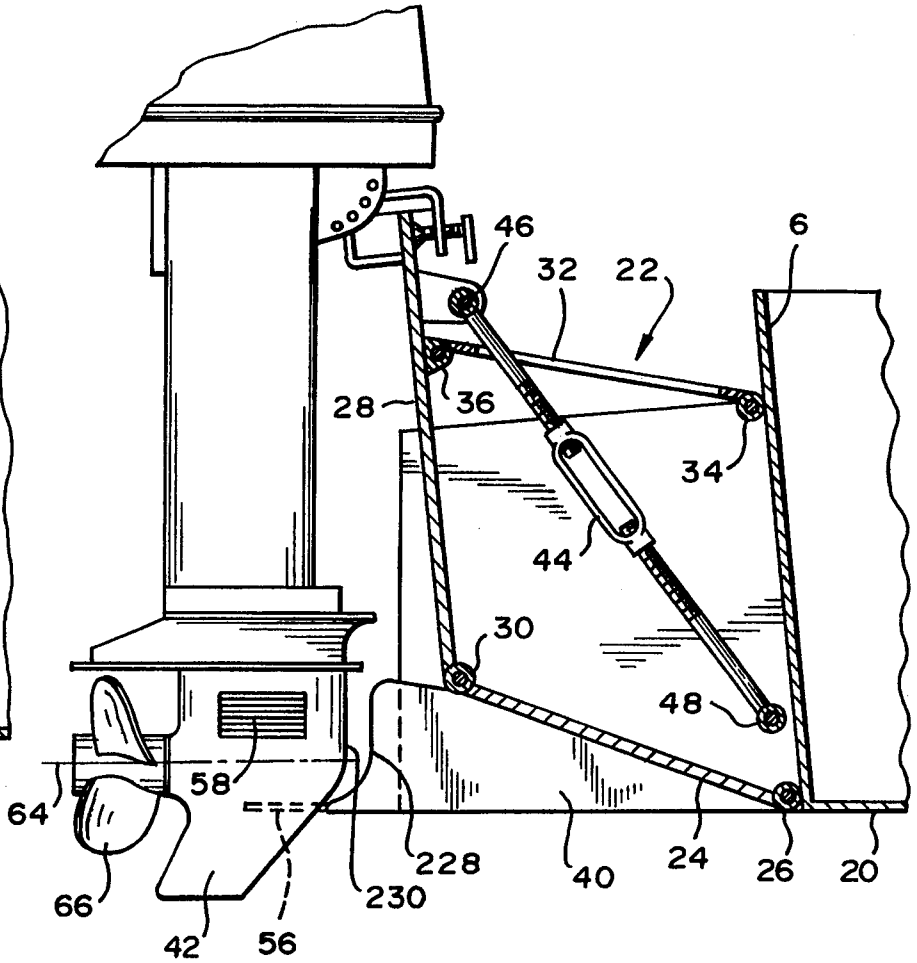
FIG. 3 is a side cross-sectional view taken along line 3—3 of FIG. 2, showing the device in a raised position.
Figure 4:
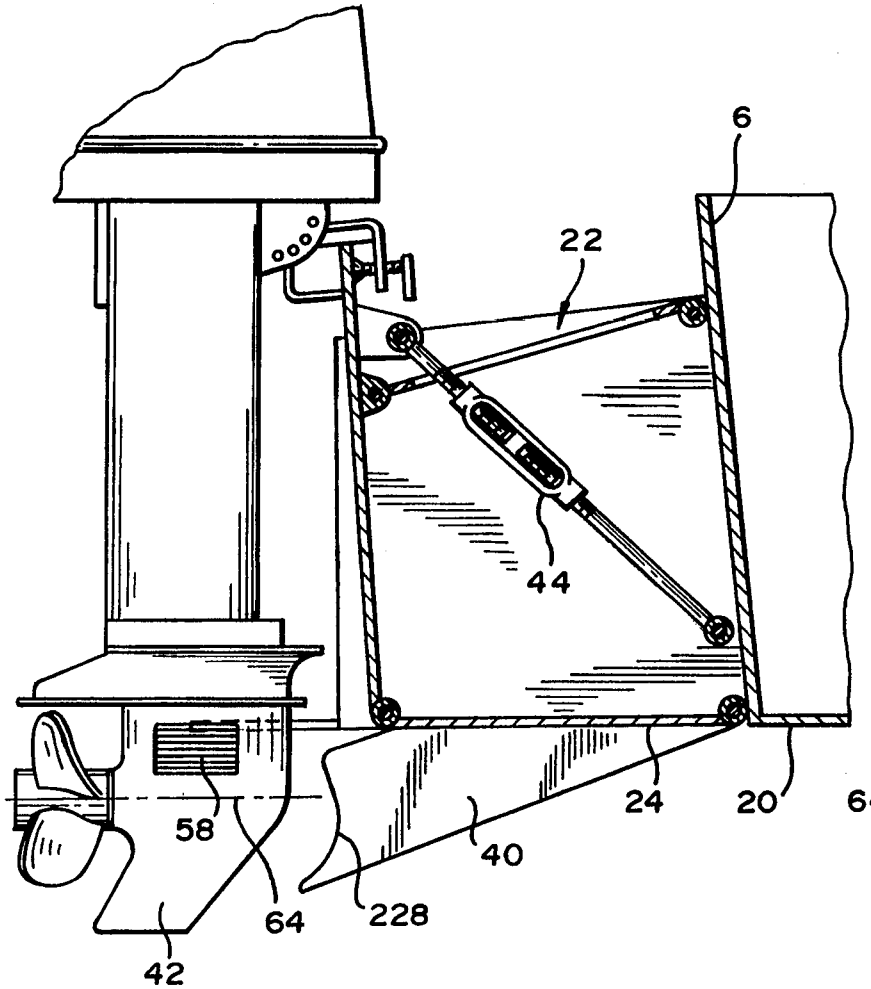
FIG. 4 is a side cross-sectional view similar to FIG. 3, showing the device in a lowered position.

The device R further comprises a pivotable box-like structure 22 that is disposed between the side plates 12 and 14, as best shown in FIGS. 1 and 2. The structure 22 has a bottom plate 24 that is pivotably secured to the side plates 12 and 14 by means of a hinge 26, as best shown in FIGS. 3 and 4. A rear plate 28 is pivotably secured at its bottom edge with the rear edge of the bottom plate 24 with a hinge 30. A top frame 32 is pivotably secured between the side plates 12 and 14 by means of a hinge 34 at its front edge and pivotably secured at its rear edge to the rear plate 28 by means of a hinge 36. The frame 32 has an opening 38 to advantageously permit the user to reach inside the structure 22 when adjusting the device R, as will be explained below.

A tapered deflector keel 40 is rigidly secured to the underside of the bottom plate 24 by conventional means, such as welding, etc., as best shown in FIGS. 2 and 3. The keel 40 is substantially aligned and cooperates with the propeller housing 42 to advantageously deflect underwater debris, vegetation or other obstructions encountered by the propeller housing 42 during shallow water operation. The keel 40 is advantageously shaped with a tapered shape and has a lagging edge portion that complements the shape of the propeller housing 42 to protect the propeller from damage from underwater debris and prevent entanglement with vegetation.

The structure 22 is configured such that the hingedly interconnected plates 24 and 28 and top frame 32 can move between the side plates 12 and 14 to permit the bottom plate 24 and hence the keel 40 to attain several positions relative to the propeller housing 42. A turnbuckle 44 pivotably secured to back plate 28 with pivot 46 and the side plates 12 and 14 with pivot 48 provides the means for moving the bottom plate 24 and the keel 40 to various positions. A person of ordinary skill in the art will understand that other adjusting means, such as piston cylinder assemblies, lever linkages, motor operated gear boxes, etc., can be used.

By adjusting the length of the turn buckle 44, the bottom plate 24 and the keel 40 can be positioned in its neutral or lowered position where it is substantially aligned with the bottom surface 20 of the boat 2. In the neutral position, the boat 2 is configured for normal mode operation in normal-depth water, as best shown in FIG. 4. By extending the length of the turn buckle 44, the side cross-sectional shape of the structure 22 is changed such that the bottom plate 24 is rotated upwardly to a raised position about the hinge 26, as best shown in FIG. 3. Since the outboard motor 4 is carried by the back plate 28, which functions as a motor mount, the raising or lowering of the lower plate 24 causes the raising and lowering of the outboard motor 4, respectively.

A pair of bolts (not shown) connecting the side plates 12 and 14 in the vicinity of their rear portions are used to maintain the relative positions between the side plates at these locations, such that minimum gap is maintained between the side plates 12 and 14 to advantageously allow the structure 22 to change shape without binding.

Figure 10:
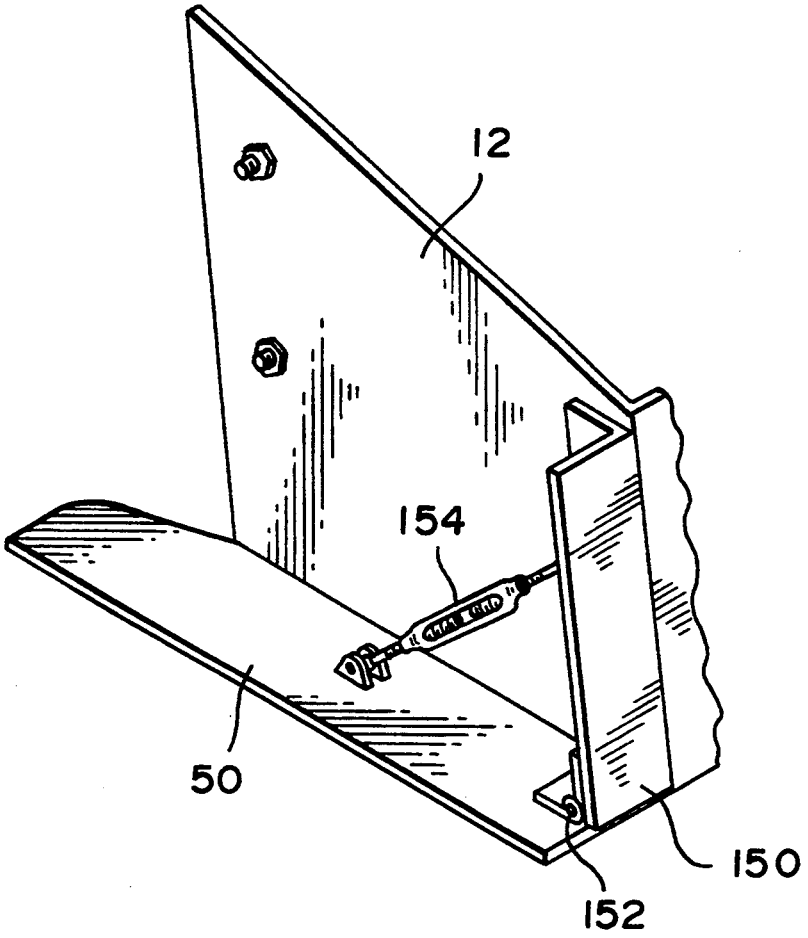
FIG. 10 is a perspective fragmentary view of the device of FIG. 1, showing an adjustable side flange.

The device R further includes side flanges 50 and 52 that are secured to the respective side plates 12 and 14 by welding or other suitable means. The flanges may also be pivotably adjustable, as best shown in FIG. 10. The flanges 50 and 52 have rear portions 54 and 56 that extend beyond the respective side plates 12 and 14, as best shown in FIGS. 1, 3 and 4. The rear portions 54 and 56 are tapered from wide to narrow in the rearward direction along their inner edges such that water escaping from underneath the flanges are advantageously directed towards the water pump suction port 58 of the outboard motor 4. Brackets 60 and 62 secured to respective side plates 12 and 14 and flanges 50 and 52 advantageously provide structural rigidity to the flanges 50 and 52, as best shown in FIG. 2.

The length of the bottom plate 24 and rear plate 28 and the top frame 32 between respective hinges 26, 30, 34 and 36 are chosen such that when the bottom plate 24 is raised from its normal or lowered position, the rear plate 28 will be angled rearwardly from the hinge 30 to cause the thrust axis 64 of the propeller 66 to be angled upwardly toward the bow of the boat 2. The upward tilting of the thrust axis 64 will advantageously provide a vertical vector that will counteract an opposing vertical vector when the boat 2 is operating in shallow water mode. By selecting the proper lengths for the bottom plate 24, rear plate 28 and the top frame 32 and the points where they are hinged, the thrust angle of the propeller 66 can automatically move from a preferred position during shallow water operation to a preferred position for lowered normal-depth water operation.

The flanges 50 and 52 advantageously provide a stabilizing effect in minimizing the draw-down of the stern 6 of the boat 2 during shallow water operation and advantageously force water up to the propeller 66 and the water pump suction 58. Minimizing the draw-down of the stern advantageously minimizes the energy expended in moving the boat through the water and promotes greater stability.

Another embodiment of the present invention is disclosed as device S for use in semi-V bottom boat 68, as best shown in FIG. 5. The device S is similar to the device R and the same designations will be used for identical parts in the following description. The device S has the side plates 12 and 14 secured to the transom of the boat 68. The box-like structure 22 disposed between the side plates 12 and 14 has a bottom plate 70 with a flat rear portion 72 and a V-angled forward portion 74 that duplicates the angle 78 of bottom of the boat 68, as best shown in FIGS. 6 and 7. The forward portion 74 is rigidly secured to a sleeve 76 that comprises a pair of identical truncated cones that have the same angle 78 of the bottom of the boat 68, as best shown in FIG. 6. A shaft 80 received in the sleeve 76 and secured to the side plates 14 and 12 permits the bottom plate 70 to pivot. A transition L-shaped bracket 82 that is fixedly secured to the transom 6 of the boat provides a transition from the bottom of the boat 68 to the bottom plate 70. The bracket 82 has a bottom surface that is configured to match the angle 78 of the bottom of the boat 68. The bracket 82 is configured to have minimum clearance between its rear edge 84 and the sleeve 76 to advantageously provide a smooth transition for the water flow underneath the boat. The sleeve 76 advantageously provides the same angle 78 as it pivots about the shaft 80, thereby maintaining this smooth transition between the bottom of the boat and the bottom plates 70 at various positions.

Figure 8:
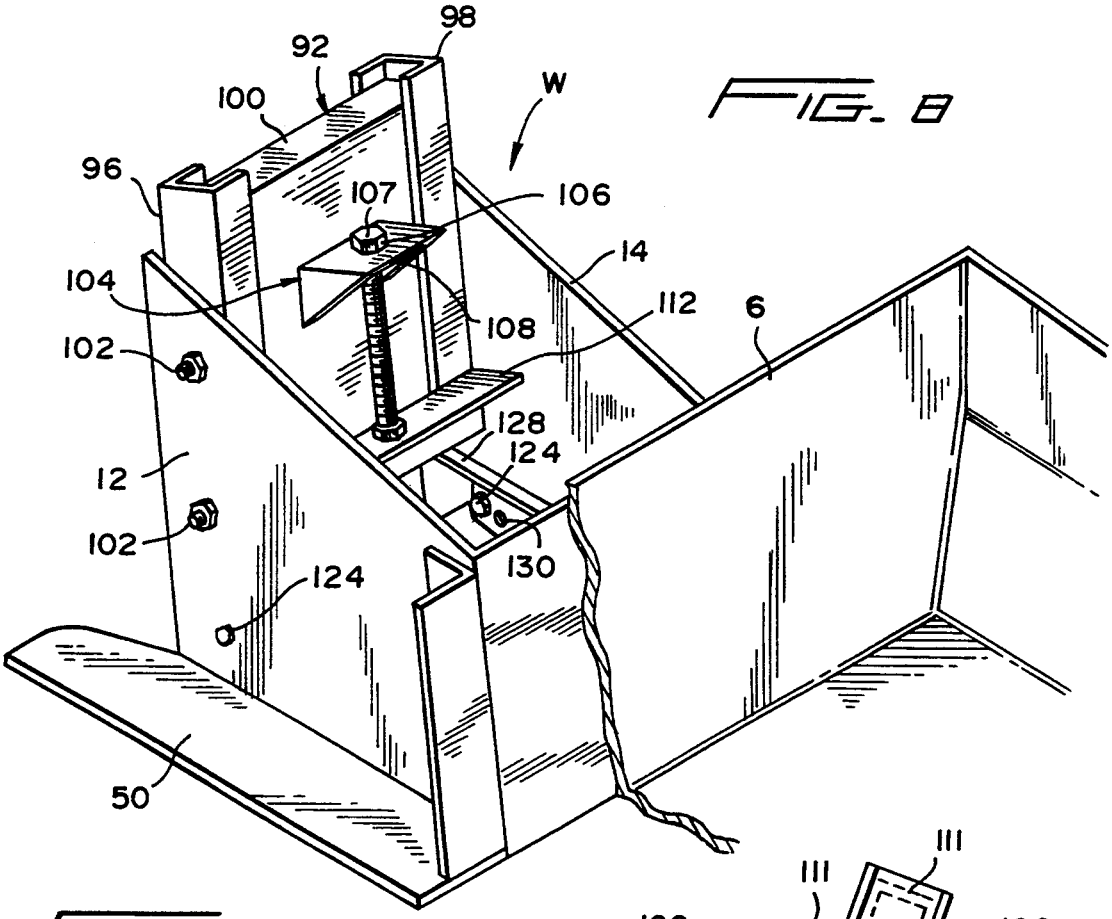
FIG. 8 is a perspective view of another embodiment of the present invention.

Another embodiment of the present invention is disclosed as device W, as best shown in FIGS. 8 an 9. The device W is similar to the device R and the same designations will be used for identical or similar parts in the following description. The device W has an adjustable motor mount 92 disposed between and secured to the side plates 12 and 14. The motor mount 92 has two parallel channel guides 96 and 98 that slidingly support a mounting block 100 onto which the outboard motor 4 is clamped. A pair of bolts 104 or other suitable means secure the guides 96 and 98 to the respective side plates 12 and 14.

Figure 9:
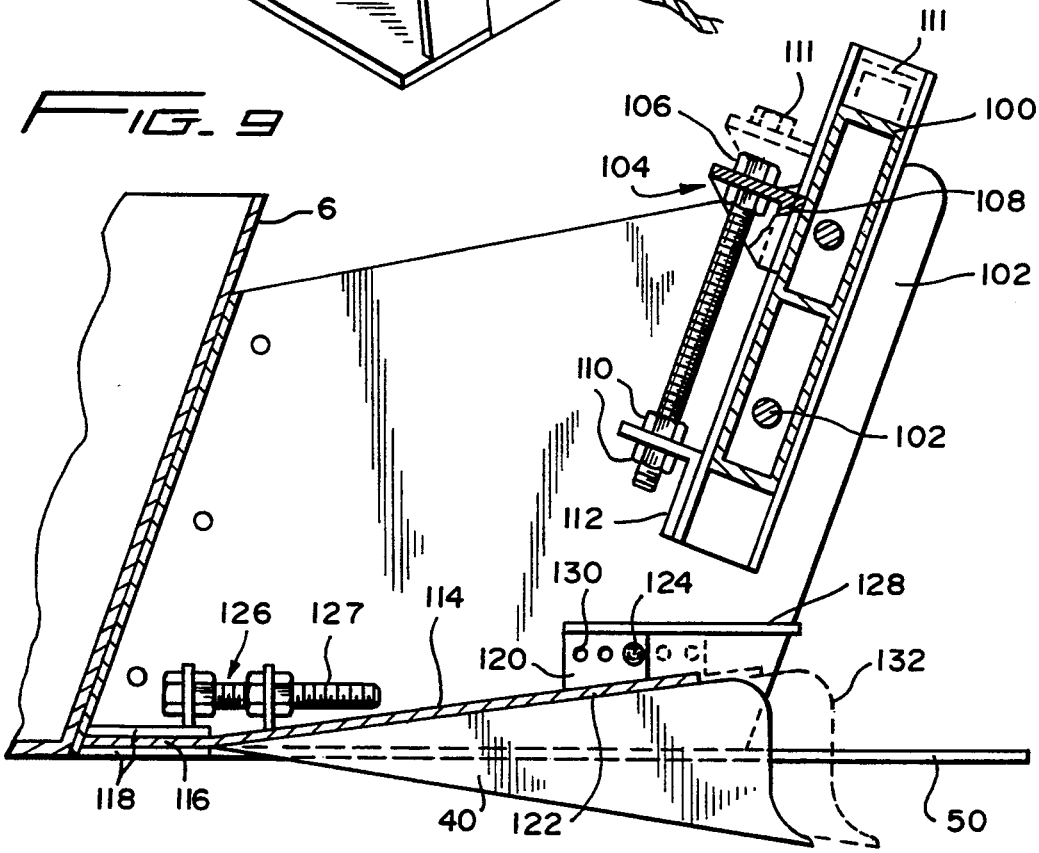
FIG. 9 is a side cross-sectional view of FIG. 8.

A jack assembly 104 is used to raise and lower the mounting block 100 relative to the fixed guides 96 and 98. One end of a jack bolt 106 is rotatably secured to a bracket 108 that is in turn fixedly secured to the mounting block 100. The other end of the jack bolt 106 cooperates with nuts 110 that are rigidly secured to a bracket 112 that is in turn rigidly secured to the guides 96 and 98. A person of ordinary skill in the art will understand that turning the jack bolt 106 will cause the bracket 108 to be displaced relative to the guides 96 and 98, thereby lowering or raising the mounting block 100, as indicated in phantom lines 111 in FIG. 9. The outboard motor 4 secured to the mounting block 100 will therefore be correspondingly lowered or raised.

Figure 11:
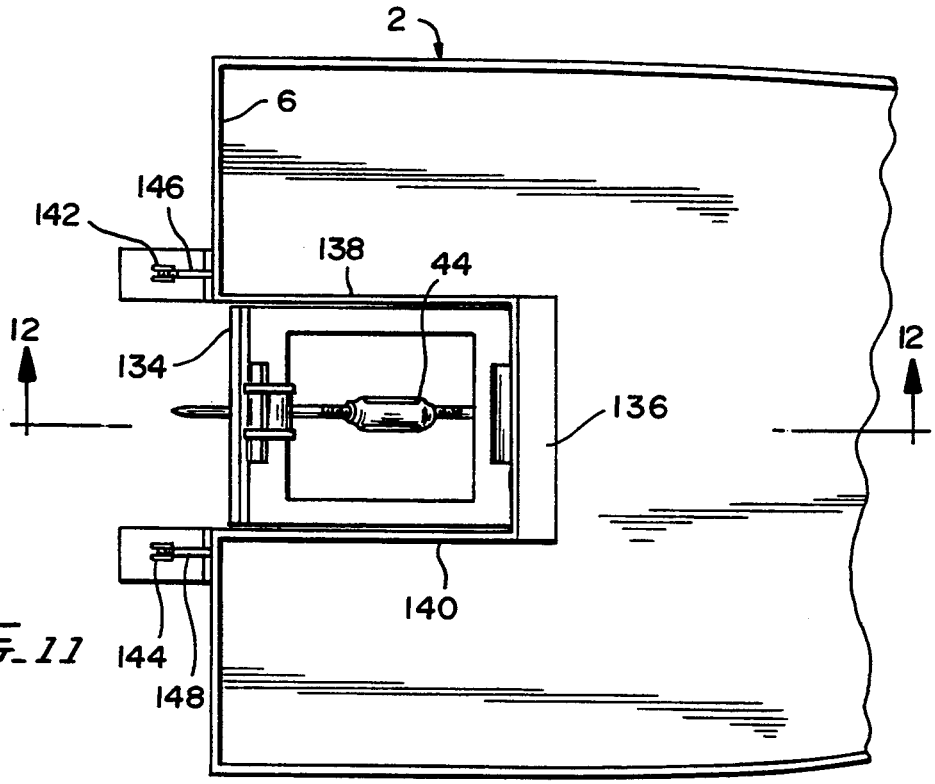
FIG. 11 is fragmentary top plan view of a stern portion of a boat integrated with the device of FIG. 1.

The device W has an adjustable bottom plate 114 disposed between the side plates 12 and 14, as best shown in FIG. 11. The bottom plate 114 has a forward portion 116 that is disposed between two plates 118. A bracket 120 rigidly fixed to a rear portion 122 of the bottom plate 114 is secured by a bolt or other conventional means to the respective side plates 12 and 14. A jack assembly 126 operably secured to the plates 118 and the bottom plate 114 enables the bottom plate 114 to be slid forwardly or rearwardly, after the bolt 124 has been removed, to advantageously retract the keel 40 when the outward motor 4 is lowered for normal operation or to adjust the keel 40 relative to the propeller housing 42 for shallow water operation. A guide rail 128 provides a guide for the bracket 120 as it moves laterally during adjustment. A plurality of holes 130 on the bracket 120 advantageously permit the bottom plate 114 to be secured at different positions, generally indicated by the phantom lines 132. The device W is secured to the transom 6 of the boat by bolts (not shown) or by other suitable means.

The side flanges 50 and 52 may be pivotably secured such that they can be adjusted downwardly about their pivots. Referring to FIG. 10, the flange 50 is secured to a mounting bracket 150 by means of a hinge 152. The bracket 150 is secured to side plate 12 and the transom 6. A turnbuckle 154 with one end pivotably secured to the flange 50 and the other end pivotably secured to the bracket 150 advantageously provides means for adjusting the orientation of the flange 50 about the hinge 152.

Figure 12:
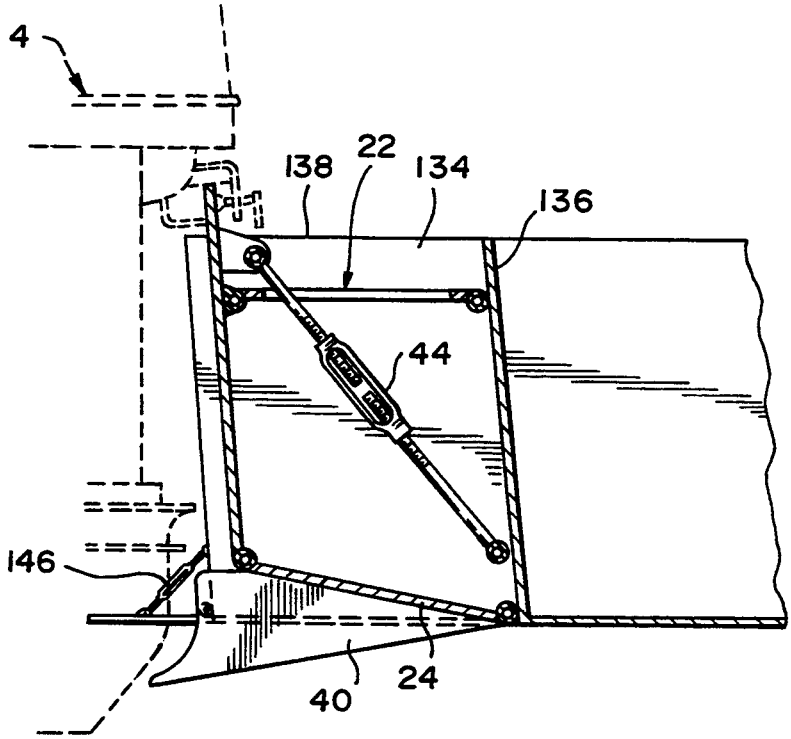
FIG. 12 is a cross-sectional view taken along line 12—12 of FIG. 11.

The present invention in its various embodiments may be advantageously integrated into the boat 2, as best shown in FIGS. 11 and 12. The stern portion of the boat 2 has a cutout 134 defined by a front wall 136 and two opposing side walls 138 and 140, as best shown in FIGS. 11 and 12. The box-like structure 22 is disposed within the cutout 134. Trim tabs 142 and 144 are pivotably secured to the transom 6 and are preferably adjusted downwardly by respective turn buckles 146 and 148.

Figure 13:
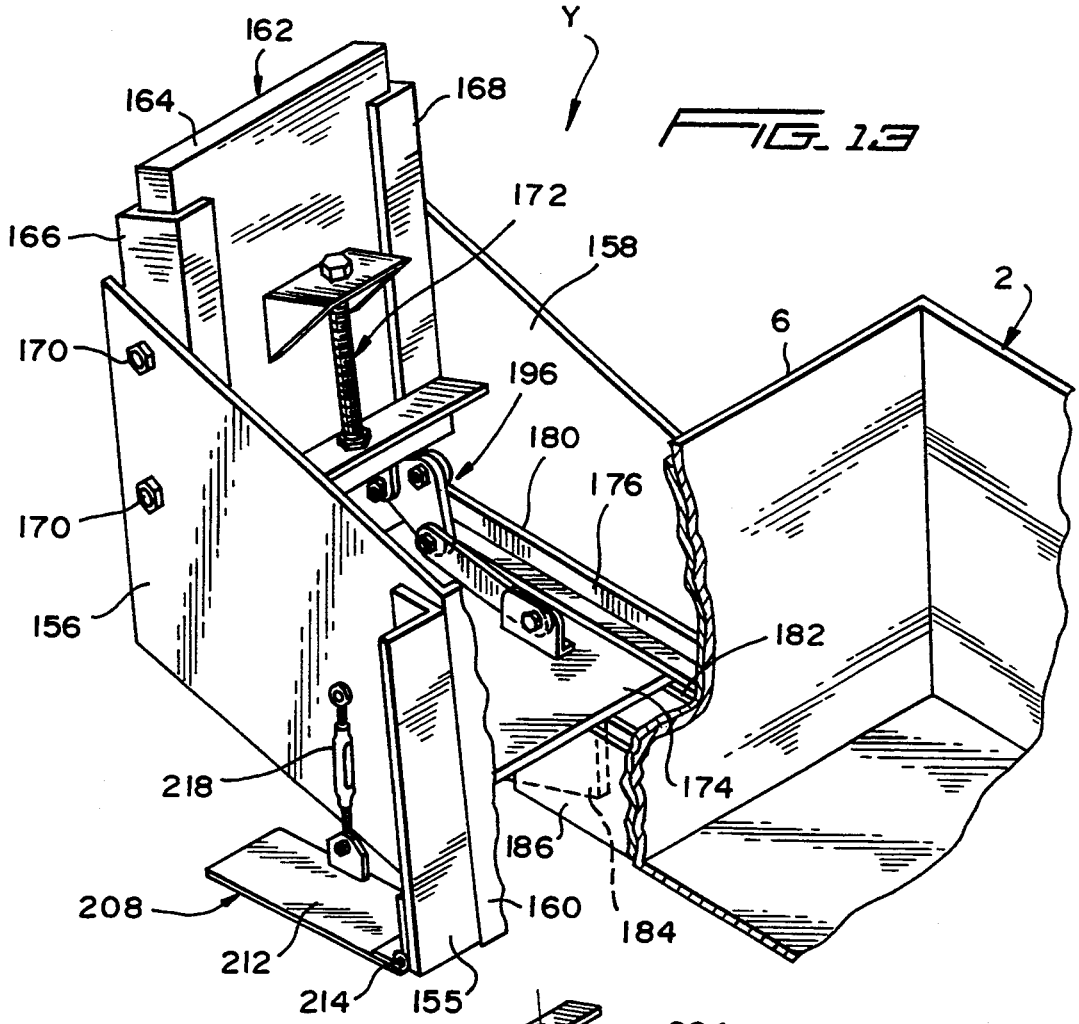
FIG. 13 is a perspective broken away view of another embodiment of the device of the present invention.
Figure 14:
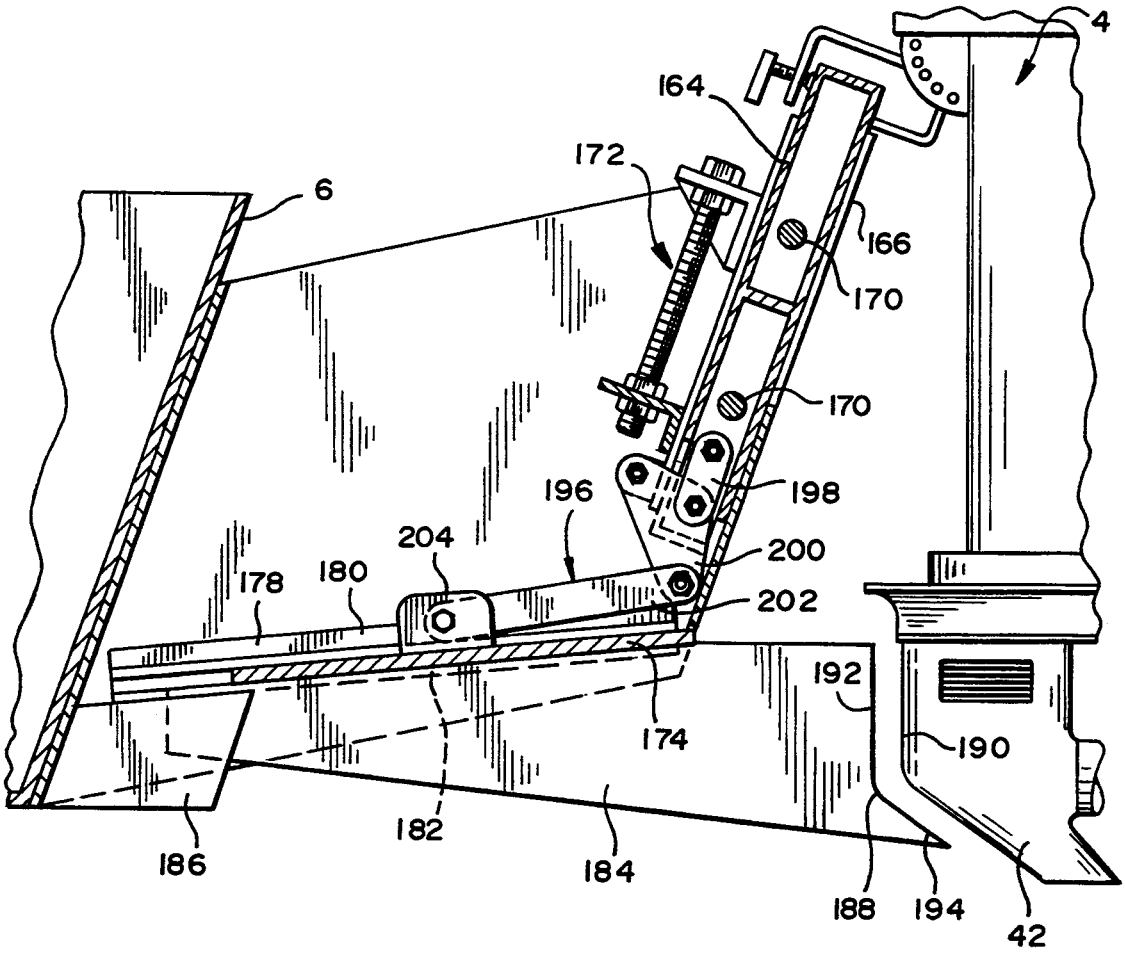
FIG. 14 is a side cross-sectional view of the device of FIG. 13, showing the device configured for shallow water operation.
Figure 15:
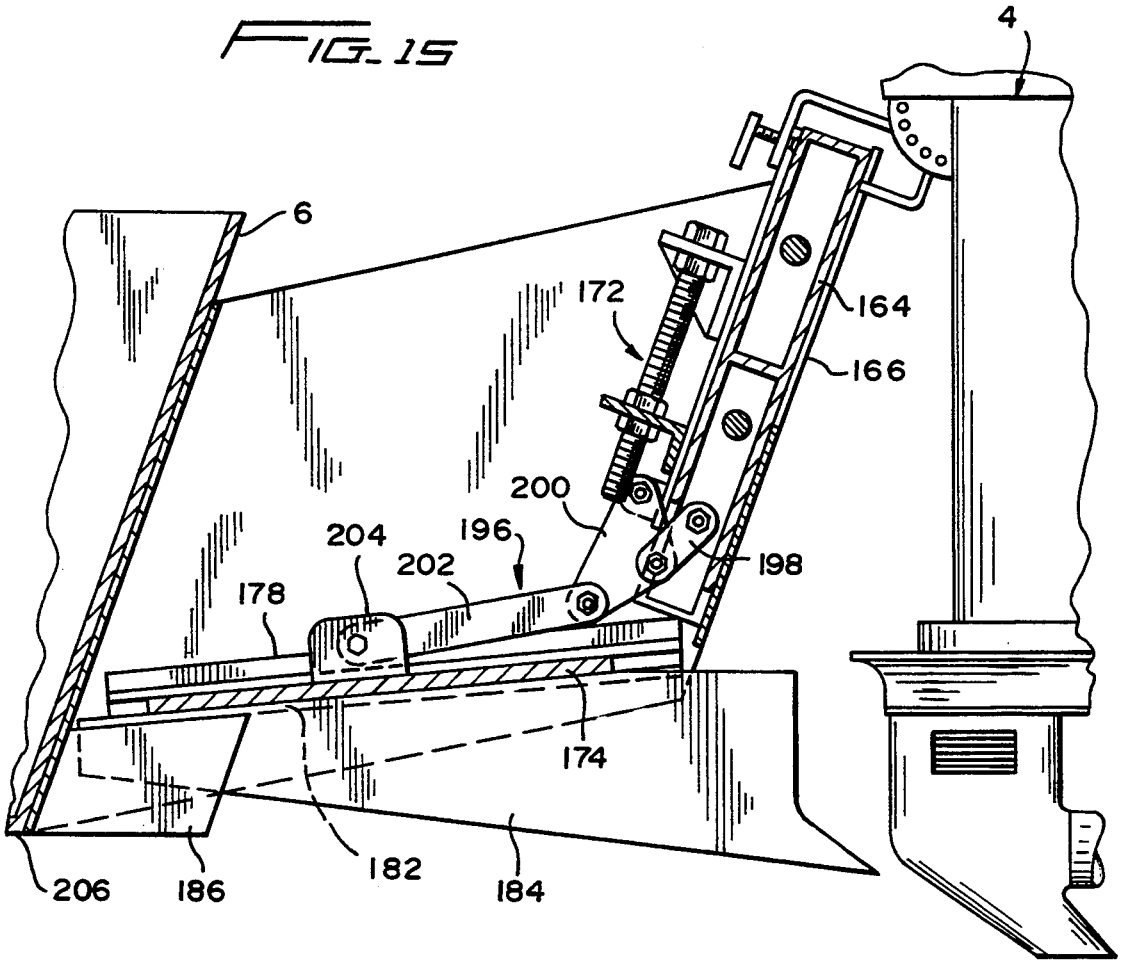
FIG. 15 is a side cross-sectional view of the device of FIG. 13, showing the device configured for normal-depth water operation.

Another embodiment of the present invention is disclosed as device Y, as best shown in FIGS. 13, 14 and 15. The device Y is secured to the transom 6 of the boat 2 by means of brackets 155. The device W has side plates 156 and 158 that are disposed substantially parallel to each other and secured to a front plate 160 by welding or other conventional means. A motor mount 162 is secured between the rear portions of the side plates 156 and 158, as best shown in FIG. 13. The motor mount 162 has a mounting block 164 that is slidably received between two channel guides 166 and 168 secured to the side plates 156 and 158 by bolts 170. A jack assembly 172 operably associated with the guides 166 and 168 and the mounting block 164 is used to raise or lower the mounting block 164.

A bottom plate 174 is slidably disposed between the side plates 156 and 158 by means of guide assemblies 176 and 178, as best shown in FIGS. 13, 14 and 15. The guide assemblies 176 and 178 allow the bottom plate 174 to slide towards and away from the transom 6. Each of the guide assemblies 176 and 178 comprises an L-shaped bracket 180 and a parallel spaced apart slat 182, as best shown in FIGS. 13 and 14.

Figure 16:
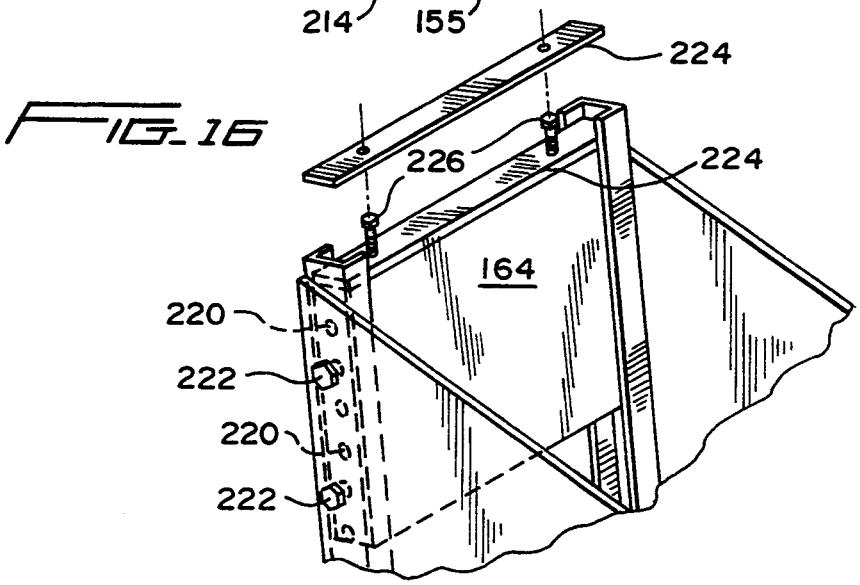
FIG. 16 is a perspective fragmentary view of another embodiment of the present invention, showing alternative means for raising the outboard motor.

A tapered deflector keel 184 is rigidly secured to the underside of the bottom plate 174. The front portion of the keel 184 is slidably received between two parallel plates 186 that are secured to the front plate 160. The plates 186 advantageously provides rigidity to the keel 184. The keel 184 is preferably tapered from narrow at its front portion to wide at its rear portion, as best shown in FIGS. 14 and 15. The keel 184 has a rear end 188 that is substantially parallel or complementary and adjacent to the front leading surface portion 190 of the propeller housing 42, as best shown in FIG. 16. The rear edge 188 has a substantially vertical portion 192 and a downwardly and rearwardly ramping portion 194 that extends beyond the vertical front leading surface portion of the propeller housing 42.

A linkage mechanism 196 operably secured to the bottom plate 174 and the mounting block 164 provides the means for positioning the keel 184 for operation with the outboard motor 4 in shallow water operation or to move the keel 184 out of the way when the outboard motor 4 is lowered for normal-depth water operation. The linkage mechanism 196 has interconnected members 198, 200 and 202 that are pivotably connected to each other, as best shown in FIG. 14. One end of the member 198 is pivotably secured to the mounting block 164 while its other end is pivotably secured to the member 200. The member 200 is substantially triangular in shape with vertex portions that are respectively pivotably connected to the members 198 and 202 and the guides 166 and 168, as best shown in FIG. 14. The member 202 is in turn pivotably secured to a bracket 204 that is in turn rigidly secured to the bottom plate 174. Raising the mounting block 164 by means of the jack assembly 172 causes the bottom plate 174 to be extended rearwardly and outwardly by means of the linkage mechanism 196, as best shown in FIG. 14. Similarly, lowering the mounting block 164 causes the bottom plate 174 to retract, as best shown in FIG. 15. Since the keel 184 is secured to the bottom plate 174, the extension of the bottom plate 174 advantageously positions the keel 184 relative to the propeller housing for shallow water operation. Similarly, the retraction of the bottom plate 174 advantageously takes the keel 184 out of the way of the descending outboard motor 4.

The side plates 156 and 158 and the bottom plate 174 are used to support the bottom keel 184. Other structures for supporting the keel 184 may be used.

The bottom plate 174 is disposed above the bottom surface 206 of the boat, and angled upwardly towards the rear as best shown in FIGS. 14 and 15. The bottom plate 174 is positioned above the bottom 206 of the boat such that any tunnel effect, which decreases the efficiency of the boat, is minimized or avoided.

Trim tabs 208 are disposed adjacent the respective side plates 156 and 158, as best shown in FIG. 13. The trim tab 208 has a flange 212 that is secured by hinge 214 to a bracket 216. The flange 212 is adjusted to a preferred downward angle by means of a turnbuckle 218.

The bottom plate 174 may be rigidly secured to the side plates 156 and 158 by welding or other conventional means such that keel 184 is positioned for shallow water operation. In this case, the boat would be used primarily in shallow water. The linkage mechanism 196 would therefore not be needed, since there would be no need to lower the outboard motor 4. Additionally, the jack assembly 172 may be replaced with a series of vertically spaced holes 220 in the mounting block 164 and securing bolts 224, as best shown in FIG. 16. For further height adjustments, a plurality of shims 224 secured by bolts 226 to the mounting block 164 may be used to adjust or lower the outboard motor in smaller increments.

OPERATION

In operation, the device of the present invention is used to raise or lower the outboard motor 4, depending on whether the boat 2 is being used for shallow or normal-depth water. In the embodiment of the invention in device R, the raising or lowering of the outboard motor is accomplished by lengthening or shortening the turnbuckle 44. Under normal use, the device R is positioned with bottom plate 24 substantially in line with the bottom of the boat, as best shown in FIG. 4. For shallow water operation, the turnbuckle 44 is lengthened, thereby forcing the structure 22 to change its shape in such a way that the outboard motor is raised, as best shown in FIG. 3. The raising of the outboard motor is accompanied by the raising of the keel 40 into its preferable position relative to the propeller housing 42, wherein the trailing edge 228 of the keel 40 is substantially parallel with and adjacent to the leading surface 230 of the propeller housing 42. The preferable height for the outboard motor 2 is where the tunnel effect is minimized and water flow to the suction port 58 is maintained. In the raised position, the thrust axis 64 of the motor is disposed slightly upwardly towards the boat to advantageously counteract the downward force created by the weight of the motor and any draw-down from any tunnel effect. In this manner, the boat is kept substantially level and relatively stable, unlike standard tunnel boats. The side flanges 54 and 56 are disposed downwardly away from the boat to advantageously maintain the boat substantially level and stable.

The device S operates substantially similarly to device R.

For device W, the bottom plate 114 is disposed such that the keel 40 is positioned adjacent the propeller housing 42 for shallow water operation. Lateral adjustment of the keel 40 is effected by means of the jack assembly 126, which is effective in retracting or extending the keel 40 relative to the outboard motor 4. Turning the jack bolt 127 in either direction will cause the bottom plate 122 to move laterally, guided by the parallel plate 118 and the guide rail 128.

Raising and lowering of the outboard motor 4 is accomplished by the jack assembly 104. The mounting block 100 is raised to position 111 when the jack bolt 106 is turned counter-clockwise. The bracket 112 remains stationary, since it is rigidly secured to the guides 96 and 98, while the mounting block 100 rises with the bracket 108 to which the mounting block 100 is rigidly secured and is held captive by the bolt 106. The flanges 50 and 52 are either permanently secured to the side plates 12 and 14 or are pivotably adjustable, as best shown in FIG. 10.

Where the present invention is integrated into the boat 2, as best shown in FIGS. 12 and 13, the operation is similar to that of the device R. The motor 4 and the keel 40 are raised for shallow water operation by adjusting the turnbuckle 44. The preferred height for the keel 40 is where tunneling under the bottom plate 24 is minimized or avoided. The trim tabs 142 and 144 are angled downwardly to advantageously maintain the boat relatively level and stable.

In the device Y, the bottom plate 174 and the keel 184 are not raised or lowered. Instead the keel 184 is prepositioned above the bottom of the boat for shallow water operation. However, the keel 184 may be retracted to clear the propeller housing 42 when the motor is lowered for normal-depth water operation, as best shown in FIG. 15. The keel 184 is supported by the bottom plate 174 and the side plates 156 and 158. Lowering the outboard motor 4 by actuating the jack bolt assembly 172 automatically causes the keel 184 to retract forward to thereby advantageously clear the propeller housing 42.

If the boat 2 is used primarily for shallow water, the keel 184 is preferably fixed in place. Height adjustments for the outboard motor 4 is accomplished by providing an appropriate number of shims 224 above the mounting block 164 before the outboard motor 4 is mounted or by relocating the mounting block to higher or lower mounting holes 220. The trim tabs 208 are set preferably downwardly to advantageously maintain the boat relatively level. Once the preferred orientation for the trim tabs is found, the trim tabs may be permanently secured in place.

Although several embodiments of the invention are disclosed herein with specific features, it is understood that the different features are interchangeable among the various embodiments.

It should be understood by a person of ordinary skill in the art that the any one of embodiments of the invention in device R, S and W may operate in a tunnel mode when secured to the boat, although the preferred operation is to minimize any tunnel effect.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A device for permitting a boat to operate in shallow water, comprising:

a) a bottom plate having front and rear ends, said bottom plate for pivotably connecting to a transom of a boat at said front end, said bottom plate having a bottom surface;

b) a motor mount having top and bottom ends, said motor mount bottom end being pivotably connected to said bottom plate rear end;

c) said motor mount being adapted to carry an outboard motor such that the propeller is disposed below said bottom plate, the propeller having a housing with leading surface;

d) first and second side plates for securing to the transom of the boat and transversely disposed respectively on each side of said bottom plate;

e) a keel secured to said bottom surface of said bottom plate, said keel having a lagging edge having a substantially complementary profile as the leading surface of the propeller housing; and f) means for moving said bottom plate about said front end such that said keel lagging edge is disposed adjacent the propeller housing leading surface when said bottom plate is in a raised position for shallow water operation.

2. A device as in claim 1, wherein:

a) said motor mount top end is adapted to move counter-clockwise away from the boat as said bottom plate pivots upwardly such that the axis of rotation of the propeller is disposed upwardly.

3. A device as in claim 1, and further comprising:

a) first and second flanges secured to respective first and second side plates.

4. A device as in claim 3, wherein:

a) said flanges include portions extending beyond said side plates; and b) said portions have inner edges disposed outwardly away from said side plates.

5. A device as in claim 1, and further comprising:

a) first and second flanges for pivotably securing to the transom.

6. A device as in claim 1, wherein:

a) said moving means comprises a top bracket having a front end for pivotably connecting to the transom and a rear end pivotably connected to said motor mount top end; and b) a turnbuckle diagonally secured across said bottom plate and said motor mount, whereby shortening or lengthening said turnbuckle raises or lowers said bottom plate, respectively.

7. A device as in claim 1, wherein:

a) said bottom plate is disposed above the bottom surface of the boat when secured to the transom.

8. A device as in claim 1, wherein:

a) said bottom plate is disposed substantially flush with the bottom surface of the boat when secured to the transom.

9. A device as in claim 8, further comprising:

a) a transition sleeve between said bottom plate and the transom.

10. A device as in claim 1, wherein:

a) said keel is tapered.

11. A device for permitting an outboard motor boat to operate in shallow water, comprising:

a) a first support for securing to a transom of a boat and extending rearwardly therefrom;

b) a keel secured to said first support and extending downwardly therefrom and rearwardly from the transom;

c) a motor mount for supporting an outboard motor with a propeller housing having a leading surface, said motor mount for positioning the motor in a raised position to permit the boat to operate in shallow water;

d) said keel being substantially flat in cross-section and including a rear edge for being disposed adjacent the leading surface of the propeller housing when the motor is in said raised e) said keel for being disposed in front of the axis of rotation of the propeller when the motor is in said raised position; and f) said keel having a bottom edge adapted to divert debris away from the propeller during operation of the boat.

12. A device as in claim 11, wherein:

a) said keel is tapered from narrow to wide in the direction away from the transom.

13. A device as in claim 11, and further comprising:

a) first and second trim tabs disposed on each lateral side of said first support.

14. A device as in claim 13, wherein:

a) said trim tabs are pivotably secured to the transom.

15. A device as in claim 11, and further comprising:

a) second and third supports operably associated with said first support; and b) said first support is disposed between said second and third supports.

16. A device as in claim 15, wherein:

a) said motor mount is disposed between said second and third supports.

17. A device as in claim 16, wherein:

a) said motor mount is selectively vertically adjustable between said second and third supports.

18. A device as in claim 11, wherein:

a) said first support is disposed substantially flush with the bottom of the boat when secured to the transom.

19. A device as in claim 11, wherein:

a) said first support is disposed a distance above the bottom of the boat when secured to the transom.

20. A device as in claim 11, wherein:

a) said first support is pivotably adjacent the transom.

21. A device as in claim 11, wherein:

a) said motor mount is vertically adjustable; and b) said motor mount is operably associated with said first support such that raising and lowering of said motor mount causes said first support and said keel to extend toward and retract away from the motor, respectively.

22. A device as in claim 11, and further comprising:

a) adjusting means for extending and retracting said first support relative to the transom.

23. A device as in claim 22, wherein:

a) said adjusting means comprises second and third supports operably associated with said first support;

b) said first support is disposed between said second and third supports;

c) guides operably associated with respective second and third supports for slidingly securing said first support; and d) a jack for selectively sliding said first support along said guides.

24. A device as in claim 23, wherein:

a) said jack comprises a bolt and a nut operably associated with said first support and the transom such that turning said bolt causes said first support to move in said guides.

25. A device as in claim 11, wherein:

a) said motor mount is vertically adjustable; and b) linkage operably associated with said motor mount and said first support for automatically moving said first support as said motor mount is raised and lowered.

26. A device as in claim 25, wherein:

a) said linkage includes a plurality of linkage members pivotably secured to each other such that upward and downward motion of said motor mount causes lateral motion of said first support.

27. A device as in claim 11, wherein:

a) said motor mount is vertically adjustable;

b) said motor mount comprises a pair of channel guides and a mounting block disposed between said channel guides;

c) second and third supports secured to the transom and respective channel guides; and d) a jack operably secured to said channel guides and said mounting block for raising and lowering said mounting block relative to said channel guides.

28. A device as in claim 11, and further comprising:

a) removably secured shims disposed on top of said motor mount.

29. A device as in claim 11, and further comprising:

a) first and second flanges disposed on each lateral side of said first support;

b) said flanges including portions extending beyond said first support; and c) said portions have inner edges disposed outwardly away from said first support.

30. A device for permitting a boat to operate in shallow water, comprising:

a) a bottom plate having front and rear ends, said bottom plate for connecting to a transom of a boat at said front end, said bottom plate having a bottom surface;

b) first and second side plates for securing to the transom of the boat and disposed respectively on each side of said bottom plate;

c) a motor mount being adapted to carry an outboard motor in a raised position to permit the boat to operate in shallow water, said mount being secured to said first and second side plates, the outboard motor having a propeller housing with a leading surface;

d) a tapered keel secured to said bottom surface of said bottom plate, said keel having a wide portion for being disposed adjacent the propeller housing and a narrow portion for being disposed near the transom; and e) said wide portion having a rear edge for being disposed in front of the axis of rotation of the propeller such that debris encountered during operation of the boat is directed downwardly and away from the propeller.

31. A device as in claim 30, wherein:

a) said rear edge is substantially parallel to the leading surface of the propeller housing.

32. A boat for operating in shallow water, comprising:

a) a stern portion including a cut-out having front and opposed side walls;

b) a first support disposed within said cut-out;

c) a keel secured to said first support and extending downwardly therefrom;

d) a motor mount for supporting an outboard motor with a propeller housing having a leading surface, said motor mount for positioning the motor in a raised position to permit the boat to operate in shallow water; and e) said keel including a rear edge for being disposed adjacent the leading surface of the propeller housing and in front of the axis of rotation of the propeller when the motor is in said raised position.

33. A boat as in claim 32, wherein:

a) said first support is a plate having a front end pivotably connected to said front wall, said plate having a rear end and a bottom surface.

34. A boat as in claim 33, wherein:

a) said motor mount includes a bottom end pivotably secured to said bottom plate rear end; and b) means operably associated with said motor mount and said bottom plate for pivoting said bottom plate such that said bottom plate and said keel are raised when said motor mount is raised for shallow water operation.

35. A boat as in claim 32, wherein:

a) said first support is slidably secured between said side walls.

36. A boat as in claim 32, wherein:

a) said first support is disposed above the bottom surface of the boat.

37. A device for permitting an outboard motor boat to operate in shallow water, comprising:

a) a frame for securing to a transom of a boat and including a portion extending rearwardly from the transom;

b) said frame including a motor mount for supporting an outboard motor at a distance away from the transom, said motor mount for positioning the motor in a raised position to permit the boat to operate in shallow water; and c) first and second horizontally pivotable trim tabs secured to said frame and disposed on each lateral side of said frame portion, respectively, such that water is directed inwardly toward said frame portion and the propeller during operation of the boat.

38. A device as in claim 37, wherein:

a) said frame portion includes a first support disposed a distance above the bottom of the boat when said frame is secured to the transom.

39. A device as in claim 37, and further comprising:

a) a keel secured to said frame portion and extending downwardly therefrom and rearwardly from the transom.

40. A device as in claim 39, wherein:

a) said keel is substantially flat in cross-section and includes a rear edge for being disposed adjacent the leading surface of the propeller housing when the motor is in said raised position; and b) said keel for being disposed in front of the axis of rotation of the propeller; and c) said keel includes a bottom edge adapted to divert debris away from the propeller during operation of the boat.

41. A device as in claim 39, wherein:

a) said keel is tapered.

* * * * *